US008151460B2

(12) United States Patent
Harpster et al.

(10) Patent No.: US 8,151,460 B2
(45) Date of Patent: Apr. 10, 2012

(54) HEAT EXCHANGER DEEP BUNDLE AIR EXTRACTOR AND METHOD FOR MODIFYING

(75) Inventors: Timothy J. Harpster, Galena, OH (US); Joseph W. Harpster, Punta Gorda, FL (US)

(73) Assignee: Intek, Inc., Westerville, OH (US)

( * ) Notice: Subject to any disclaimer, the term of this patent is extended or adjusted under 35 U.S.C. 154(b) by 1105 days.

(21) Appl. No.: 12/011,921

(22) Filed: Jan. 30, 2008

(65) Prior Publication Data

US 2009/0032233 A1 Feb. 5, 2009

Related U.S. Application Data

(60) Provisional application No. 60/898,248, filed on Jan. 30, 2007.

(51) Int. Cl.
*B21D 51/18* (2006.01)
*B21K 21/16* (2006.01)
*B23P 6/00* (2006.01)

(52) U.S. Cl. ..... 29/890.031; 29/401.1; 29/890.07

(58) Field of Classification Search ..... 29/401.1, 29/402.09, 890.031, 890.053, 890.07; 165/172, 165/175; 62/115, 183, 305, 306
See application file for complete search history.

(56) References Cited

U.S. PATENT DOCUMENTS

| | | | | | |
|---|---|---|---|---|---|
| 2,176,873 | A * | 10/1939 | Hughes | 29/890.07 |
| 4,129,180 | A * | 12/1978 | Larinoff | 165/113 |
| 4,173,060 | A * | 11/1979 | Massaro et al. | 29/890.031 |
| 5,653,281 | A * | 8/1997 | Berg et al. | 165/113 |
| 5,765,629 | A * | 6/1998 | Goldsmith et al. | 165/112 |
| 6,309,513 | B1 * | 10/2001 | Sephton | 202/155 |
| 7,926,277 | B2 * | 4/2011 | Harpster | 60/685 |
| 2005/0072185 | A1 * | 4/2005 | Taniguchi et al. | 62/475 |

* cited by examiner

*Primary Examiner* — Alexander P Taousakis
(74) *Attorney, Agent, or Firm* — Okuley Smith, LLC

(57) ABSTRACT

Disclosed is a method for effective venting of a condenser of the type having an air removal section, wherein improved is reducing dissolved oxygen or other gases content in the condensate, reducing condensate and feed water side corrosion, reducing excess condenser pressure in the condenser, and/or improving the condenser heat transfer coefficient by eliminating or reducing zones that promote subcooling selected from an air bound or a stagnant zone. The method includes replacing one or more of water filled tubes within the air bound zone or the stagnant zone with one or more vent tubes in connection with a source for venting air or other gas from the air bound zone or the stagnant zone or recognizing the ineffectiveness of an ARS in the air bound zone and providing one or more vent tubes in connection with a source for venting said air bound zone or the stagnant zone.

6 Claims, 9 Drawing Sheets

HEAT EXCHANGER DEEP BUNDLE AIR EXTRACTOR AND METHOD FOR MODIFYING

CROSS-REFERENCE TO RELATED APPLICATIONS

This application claims benefit of provisional application Ser. No. 60/898,248, filed Jan. 30, 2007.

STATEMENT REGARDING FEDERALLY SPONSORED RESEARCH

Not applicable.

BACKGROUND

The theory of condenser steam and non-condensable gas dynamics, generally described and disclosed by J. W. Harpster (U.S. Pat. Nos. 6,526,755 and 7,065,970, the "'755 and '970 patents", respectively) for power plant condensers, discloses how gas can form pockets in the tube bundle that are not under the direct or adequate influence of a vacuum pump attached to the condenser. These regions of the condenser tube bundle interfere with condensation of the steam and are the result of tube bundle configuration or inadequate venting that allow steam containing a small amount of non-condensable gas, such as from air in-leakage, to converge at a location, increase in gas concentration, and form these gas pockets.

Although a condenser can be designed and operated free of these undesirable conditions, practical modifications are needed for those condensers exhibiting this problem.

BRIEF SUMMARY

The question was posed: could one or more of the cooling tubes in the pocket region(s) be modified and used to remove the air? Discussion led to the possible mechanisms whereby this could be accomplished. A unique method and device was conceived for removing air through a tube from regions deep within a condenser tube bundle either locally or throughout the full length of the condenser on the steam side. Specifically, selected tubes within the pocket could be perforated at locations along their length. One end of these tubes would be plugged and the other end fitted with a suction device, the two ends located in their respective water boxes. The suction pressure would be maintained sufficiently lower than that of the condenser gas pocket pressure to remove these gases. An orifice may be placed in the tube to provide a pressure drop to control the amount of flow within the tube.

Later, a second unique bundle configuration of small diameter air tubes of different length was devised for removing air from a recognized gas pocket associated with inadequate, although intended, venting of a condenser along the length of a specific condenser tube bundle. Both a single tube and multiple tubes allow for planned venting at different locations between the two ends and sides of the tube bundle. The concept of using properties of hooded air removal sections as the bases for a suction device allowed modification of the ARS shroud to incorporate venting channels coupled to the air tubes that could then extend into AB zones for removal of air.

Disclosed, then, is a method for effective venting of a condenser of the type having an air removal section, wherein improved is reducing dissolved oxygen or other gases content in the condensate, reducing condensate and feed water side corrosion, reducing excess condenser pressure in the condenser, and/or improving the condenser heat transfer coefficient by eliminating or reducing zones that promote subcooling resulting from an air bound or a stagnant zone. The method includes replacing one or more of water filled tubes within the air bound zone or the stagnant zone with one or more vent tubes in connection with a means for venting air or other gas from the air bound zone or the stagnant zone or recognizing the ineffectiveness of an ARS in the air bound or stagnant zone and providing one or more vent tubes in connection with a means for venting said air bound zone or the stagnant zone.

BRIEF DESCRIPTION OF THE DRAWINGS

For a fuller understanding of the nature and advantages of the present disclosure, reference should be had to the following detailed description taken in connection with the accompanying drawings, in which.

The drawings will be described in greater detail below.

DETAILED DESCRIPTION

1. Purpose

The disclosed Deep Bundle Air Extractors ("DBA or DBA's" are unique devices used, for condenser retrofit/modification or for design in special condenser configurations, to improve condenser performance by elevating the heat transfer coefficient, to reduce condenser excess pressure, and to reduce dissolved corrosive gases in condensate, such as Dissolved Oxygen (DO), by preventing air from establishing pocket regions in unvented regions of the tube bundle or enhancing the removal of air from regions of the tube bundle specifically identified as, "Air Removal Sections" or "(ARS's)".

2. Description of the Components

The DBAE consists of two parts: (1) connection to a suction line, which is typically an existing condenser air off-take line or the low pressure end of an ARS; and (2) an air tube or multiple air tubes of geometry that may or may not extend the length of the condenser between existing tube sheets or extend sidewise within a bundle between two tube support plates. Because of typical condenser configuration, a third part may become advantageous, which is a condensate drain line to return any removed or produced condensate that may appear in the vent line back to the condenser hotwell. An optional fourth part of the DBAE is a small water vapor removal device that can either be inserted in the inlet water box, externally located in the vent line to the vacuum pump or constructed in the tube bundle as an ARS to lower water vapor content in the water vapor/air mixture being removed through the DBAE to improve the effectiveness of air removal from the condenser and reduce condensate losses.

The air tube can have a single air inlet port or have multiple restrictive venting ports located along its length. Either the single or multiple DBAE air tubes can be used to provide for scaled venting at any number of locations along the length or width of the condenser tube bundle.

3. Description of Drawings

Figure 1:
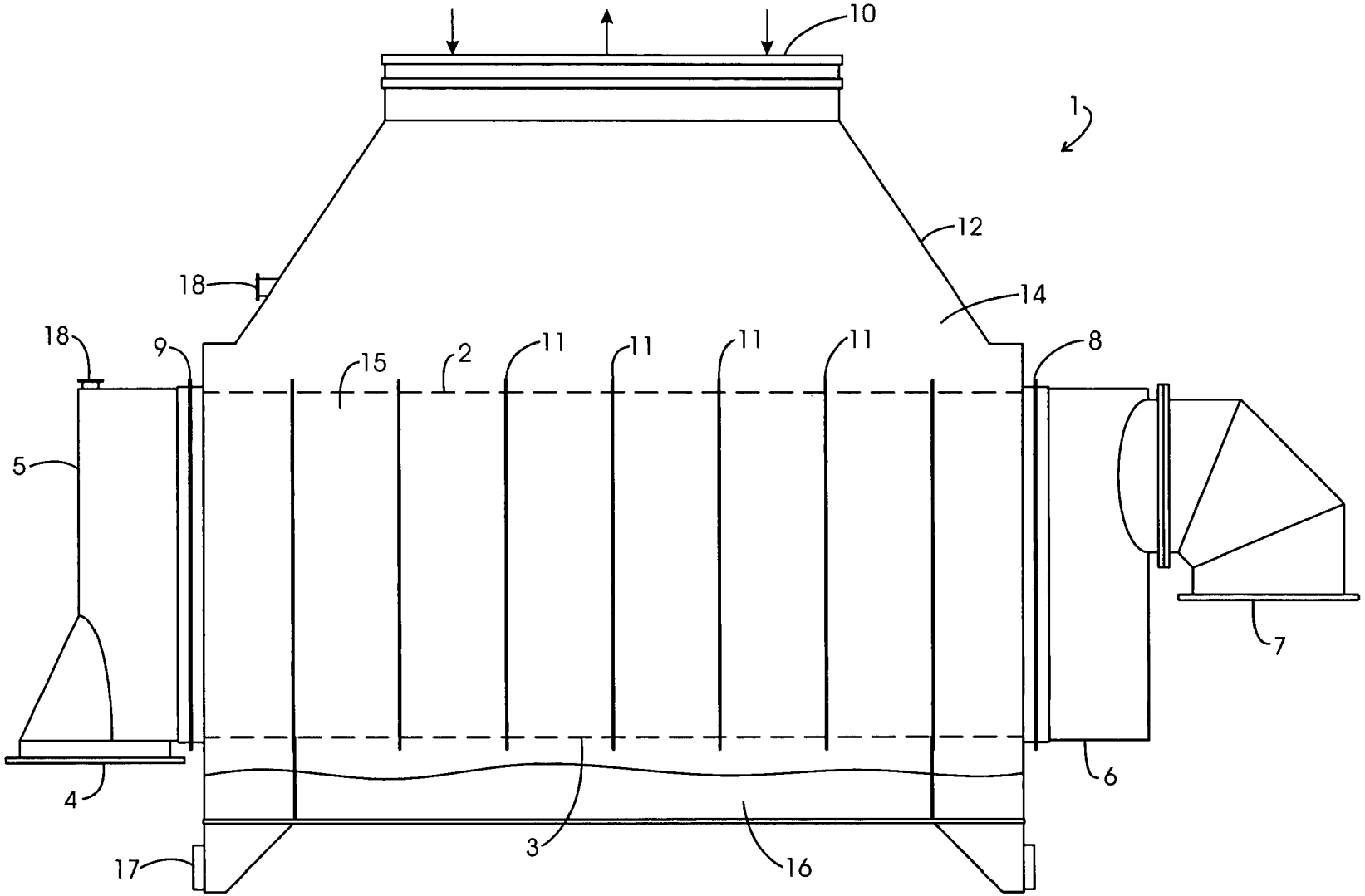
FIG. 1 is a side view of a power plant condenser.

FIG. 1 is a side view of a power plant condenser shown generally at 1. Steam, 10, at low pressure and temperature enters at the top passing through a hood, 12, to a tube bundle, 15, of horizontally configured condenser tubes located between an upper limit, 2, and a lower limit, 3. Support plates, 11, having loose fitting holes matching the tube sheets are used to dampen vibrations and support the bundle. Each tube in the bundle is seal connected between the tube sheets, 8 and 9, that isolates the low-pressure side of the condenser shell, 14, from the cooling water at higher pressure passing through the condenser tubes in bundle, 15. The inside of each tube in the bundle is in fluid connection with circulating water passing through an inlet pipe connection, 4, entering the condenser at inlet water box 5, and exiting at connection, 7, through a outlet water box, 6. There is a temperature rise in the outlet circulating water at connection 7, over the inlet temperature at pipe connection 4 due to steam condensation on the outside of each tube within the condenser shell space. The condensate falls to the bottom of the condenser in a region called a hotwell, 16, and removed by a condensate pump having a connection to a condensate outlet, 17.

Ideally the condensation rate of steam on each individual tube section along its length in the bundle of a particular condenser is strongly dependent on the circulating water temperature and the amount of noncondensable gas in the steam or water vapor/gas mixture at that location. This rate is generally independent of tube materials and their geometry, but does depend on the total amount of steam to be condensed and other operating conditions. As the circulating water temperature rises from the tube inlet to its higher temperature outlet end, caused by condensation along its length, the rate of condensation decreases. This is a consequence of the condensation process. However, there is an additional decrease at locations within the bundle caused by the presence of air that can only be modified by adequate removal of this air.

Figure 2:
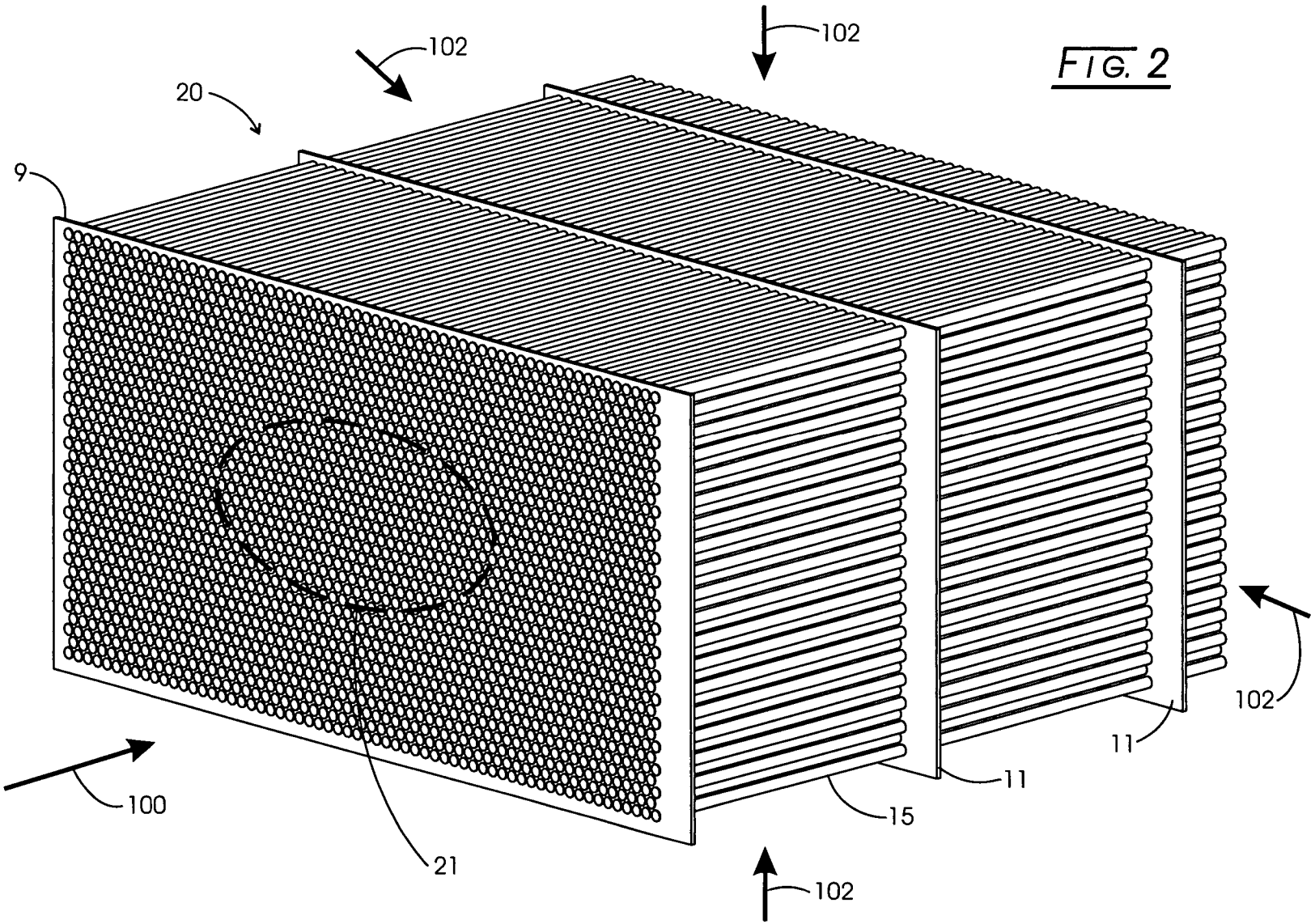
FIG. 2 shows a tube bundle or tube bundle subsection.

FIG. 2 shows a tube bundle or tube bundle subsection, 20, consisting of a tube sheet, 9, having steam, 102, on the outer side surrounding the array of tubes, 15, having circulating water, 100, flowing through them to remove heat from the steam to form liquid condensate. Also shown are two of several support plates, 11, which maintain bundle tube separation and support for the long tubes that end at the outlet tube sheet not shown. It is clear that if the steam being condensed also contains small amounts of air the air will be scavenged to near the central region of this tube bundle as indicated by the air pocket region, 21.

Figure 3:
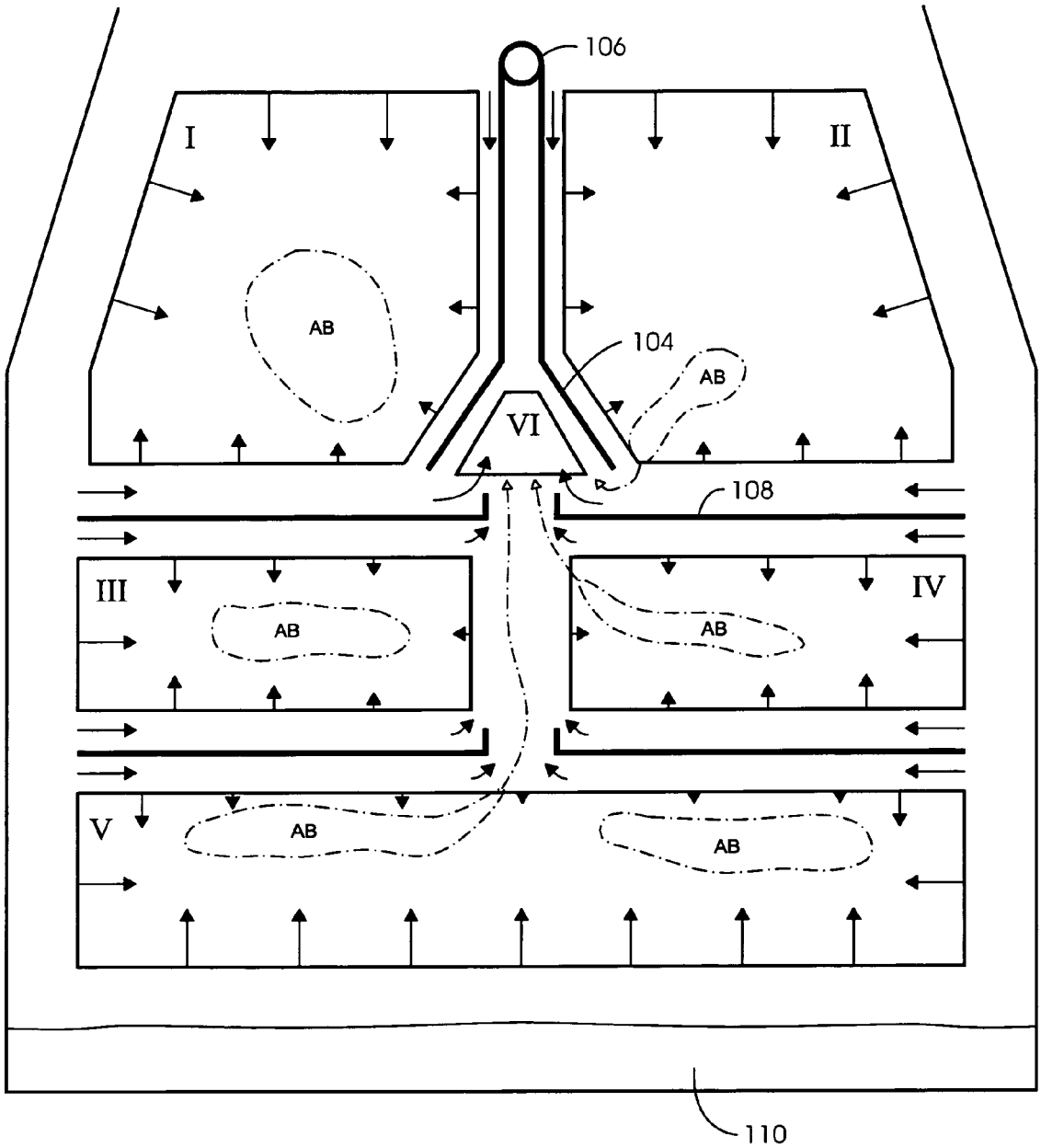
FIG. 3 shows the end of a tube sheet with each bundle subsection outlined with black tipped arrows showing steam penetration of the perimeter tubes.

FIG. 3 shows the tube sheet at the end of a tube sheet with each bundle subsection outlined with black tipped arrows showing steam penetration of the perimeter tubes. There are shown six (VI) tube bundle subsections representative of an actual condenser. With exception of actual size and shape, there are five subsections similar to the tube bundle of FIG. 2 where steam surrounds the periphery each section. As shown in the '970 patent, small amounts of air entrained with the steam can build in concentration as the steam is condensed forming air pockets, designated as Air Bound, AB, zones as shown in FIG. 3. The small bundle, VI, is provided with a hood, 104, to provide an ARS that is intended to vent the condenser through vent pipe, 106, connected to one end of hood, 104. Understanding the cause for and removing these AB zones that can extend the length and significant width of the tube bundle, either by condenser tube bundle design, their modifications or by finding suitable mechanical means to remove the air, is a purpose of the described apparatus and method.

Figure 4:
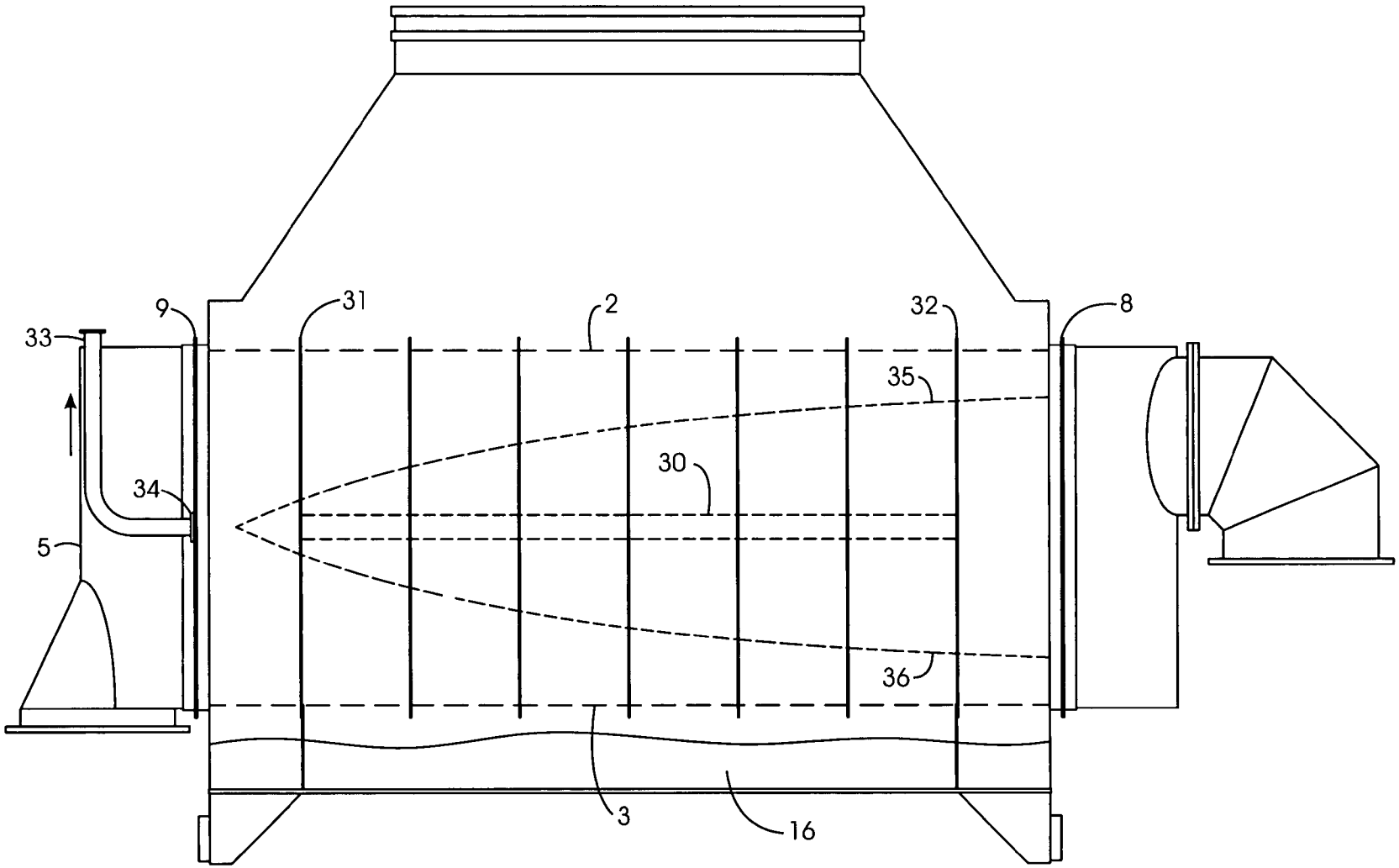
FIG. 4 shows the side view of a practical condenser.

FIG. 4 shows the side view of another actual condenser having a cavity in the central portion of the single section tube bundle devoid of cooling tubes, but with a large diameter perforated pipe, 30, extending essentially the length of the condenser between first and last support plates, 31 and 32, respectively. This has been designated the ARS section of the condenser. Venting of the condenser is accomplished by connecting a vacuum pump to a vent line, 33, that enters inlet water box 5 and bolted by a flange, 34, to the cavity region of the bundle at inlet tube sheet 9. The lack of positive suction between support plate sections can allow a variable sized conically shaped air pocket to develop having the shape defined generally by the lines, 35 and 36.

Eliminating the ineffectiveness of the ARS to remove air along the length of the condenser is a second disclosed advantage. There exist other ineffective ARS configurations that suffer the same limitations for moving air from one end of the condenser to the other by what is believed to be a temperature driven pressure differential from the hot end of the condenser to the colder inlet circulating water end. Should the lower boundary of an AB zone, 36, reach or become significantly close to the bottom of the tube bundle, components of the noncondensable gases that become dissolved in the falling and cooled condensate can enter the hotwell without being regenerated or heated sufficiently to remove the dissolved corrosive gases and enter directly into the hotwell. Therefore, there exists another advantage, which is to reduce dissolved gases in condensate leaving the tube bundle to reduce, minimize or eliminate dissolved gases in the hotwell condensate.

Figures 5, 5A:
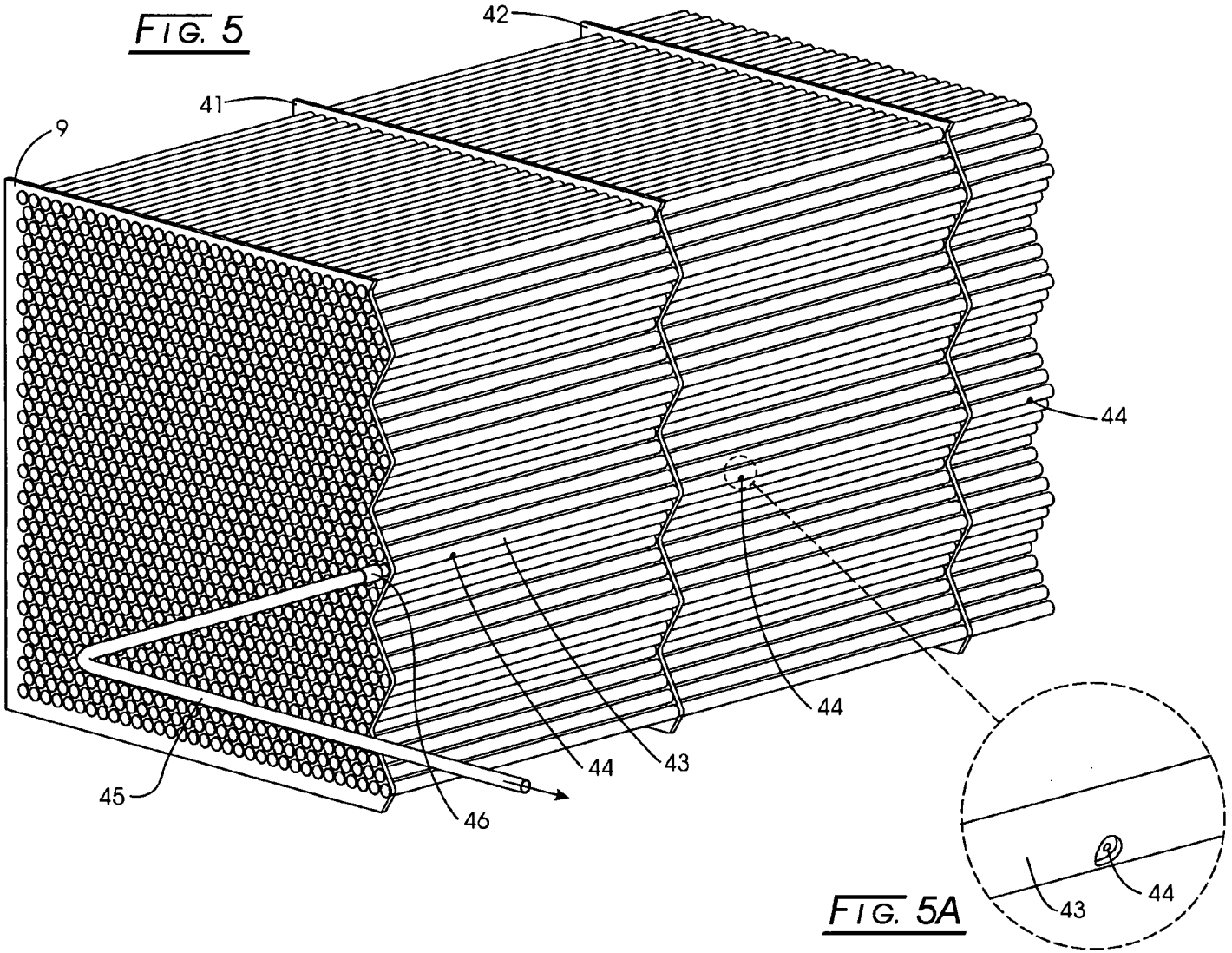
FIG. 5 is the left half of a condenser tube bundle section similar to section III or IV of FIG. 3.

FIG. 5 is the left half of a condenser tube bundle section similar to section III or IV of FIG. 3 showing inlet tube sheet 9 and two tube support plates, 41 and 42. A tube such as, 43, near the center of the inlet tube sheet may be perforated along its length, as shown at, 44, using an actuated punch. This tube also may be removed and replaced with another tube having the same diameter as, 43, but containing machined holes located at the end of recessed cups positioned along the length of the tube to reduce the ingress of falling condensate from entering the tube. A vacuum line is coupled to this tube using a suitable fitting, 46, within the water box and attached to a vacuum pump or system operating at lower pressure than that of the steam space around the tube located inside or outside the condenser shell. The holes are sized to have a defined pressure drop and to remove an adequate amount of air and local water vapor. The amount of air removal may be consistent with tube bundle section size and the applicable Heat Exchange Institute Incorporated, Standards For Steam Surface Condensers.

The foregoing description is the most simple condenser DBAE configurations allowing air to be removed from each bay that exists between tube sheets and closest tube support plate or between support plates. Any condensate entering the tube through perforations or recessed and drilled cups will be disposed of by the pumping device or drained back to the hotwell through a loop trap as shown at 55 and 56 in FIG. 6.

Figure 6:
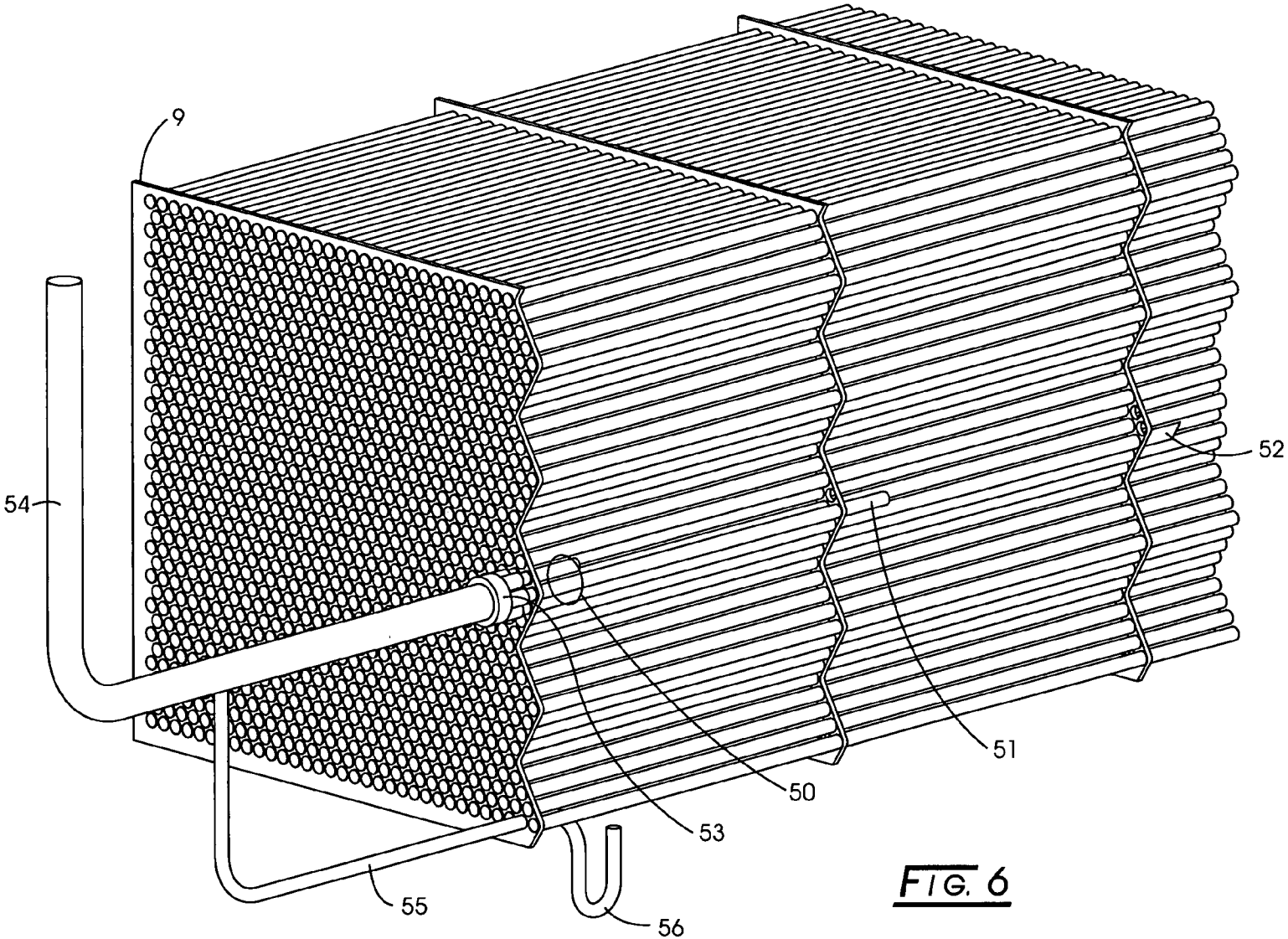
FIG. 6 shows a multiple tube DBAE configuration.

FIG. 6 also shows a multiple tube DBAE configuration, 50, for higher volume extraction and reduced pressure drop between the evacuation pump suction and the steam space within the tube bundle. Normal tubes have been removed and new tubes of various lengths have been installed. The advantage is improved selectivity for air removal from large tube bundles or bundle sections at locations where there is no current ARS section. Some tubes in an air bound zone are removed and tubes of defined length, such as at 51, are inserted so that one tube could be dedicated to a limited number of separate bays in the bundle. The inserted tube ends in the tube bundle can be left open or capped and drilled with different sized orifice holes to accommodate the amount of air to be removed and/or recessed orifices inserted along its length. These ends can be shaped, say at an angle, as shown at, 52, to inhibit the ingress of falling condensate. The end of each tube at inlet tube sheet 9 is attached in a sealed manner appropriate to condenser tube installation, which includes expanding the tube into the tube sheet. The outlet tube sheet openings may have no tubes and are plugged with suitable devices designed for this purpose.

A coupler to a large venting pipe consisting of tube insertable protrusions may be attached to each venting tube as shown at, 53. A suitable vent pipe in the approximate size range of, say, 2" to 4", 54, is weld attached or flanged to coupler 53 and coupled through the water box housing to an external vacuum system to vent the condenser section. Because condensate can enter the pipe or be formed on the internal walls of the pipe, a drain is provided at the lowest portion of the vent pipe and fed through the tube sheet by removing a bundle tube and then fitted on the shell side with a loop seal, 56, to compensate for pressure differences that can exist between the vent pipe and the shell space at the center of the tube bundle.

Figure 7:
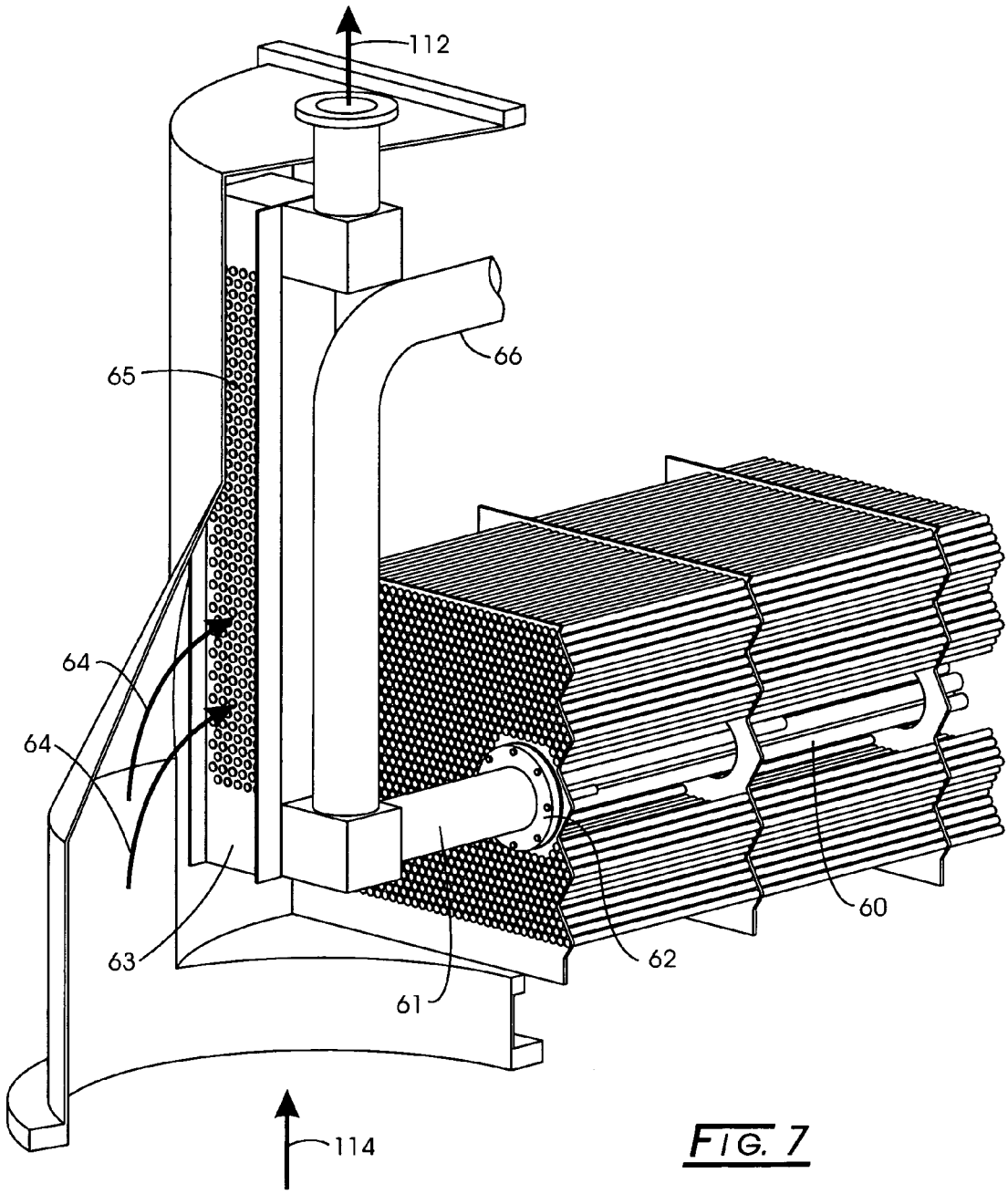
FIG. 7 shows a retrofit modification to a condenser having the air pocket description and cause given in FIG. 4.

FIG. 7 shows a retrofit modification to a condenser having the air pocket as described in FIG. 4. The central region of the tube bundle had a large diameter heavily perforated vent pipe between the first and last tube support plate, as shown at 30 in FIG. 4, has been modified or removed. Venting is accomplished by inserting multiple tube DBAE configuration of different length tubes, 60, connected to a venting pipe, 61, within the inlet water box at 62. Each bay is vented by positive suction at appropriate locations between support plates of the condenser. Another part of the disclosure is the attachment of pipe 61 to an optimal heat exchanger, 63, with cooling water passing through tubes, 65, in the heat exchanger by the velocity head of circulating water, 64, entering the inlet water box. The purpose of this heat exchanger is to enhance performance of the DBAE by reducing the water vapor density at the exit of the heat exchanger to improve the venting capability of the central region of the condenser for a relatively constant vacuum pump capacity as measured in the vent line outside the water box. The line, 66, in FIG. 7 is to connect an upper bundle similar to the bottom bundle as shown for venting into heat exchanger 63.

Figure 8:
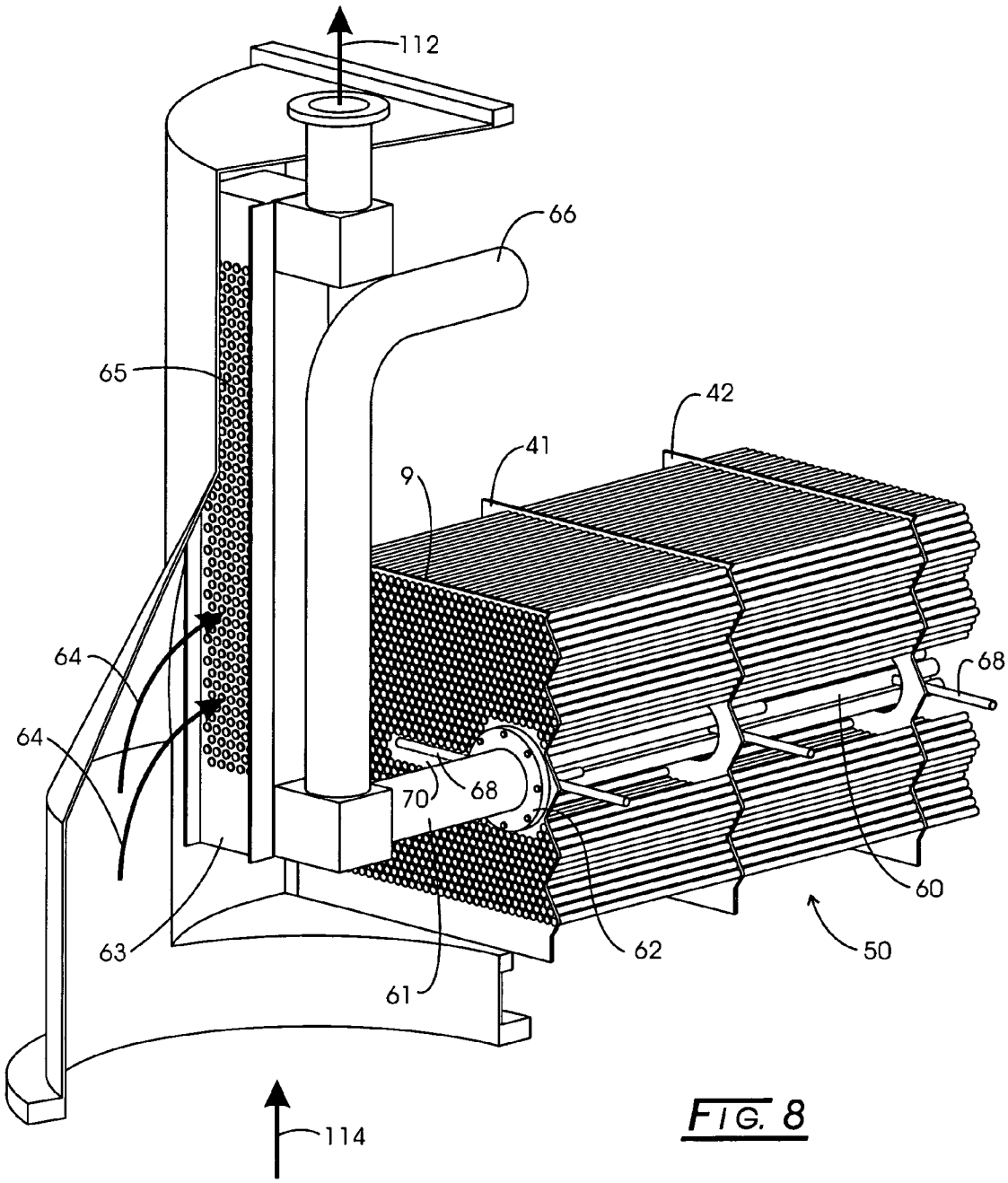
FIG. 8 shows a means for improved venting of tube bundles having air vent lanes.

Tube bundles of the type shown in FIG. 7 may contain air vent lanes to the left, right and up, down from the central region containing the perforated pipe, such as shown in FIG. 8. In the case where retubing of the condenser is being performed, the DBAE can be enhanced to include side arms, 68, for vent pipes to extend into those air vent lanes for enhanced venting. These vent pipes simply tap into the side, top or bottom of individual vent pipes, 60, which may be fitted with orifices for venting control. This configuration is applicable to retubing or design for new construction.

Figure 9:
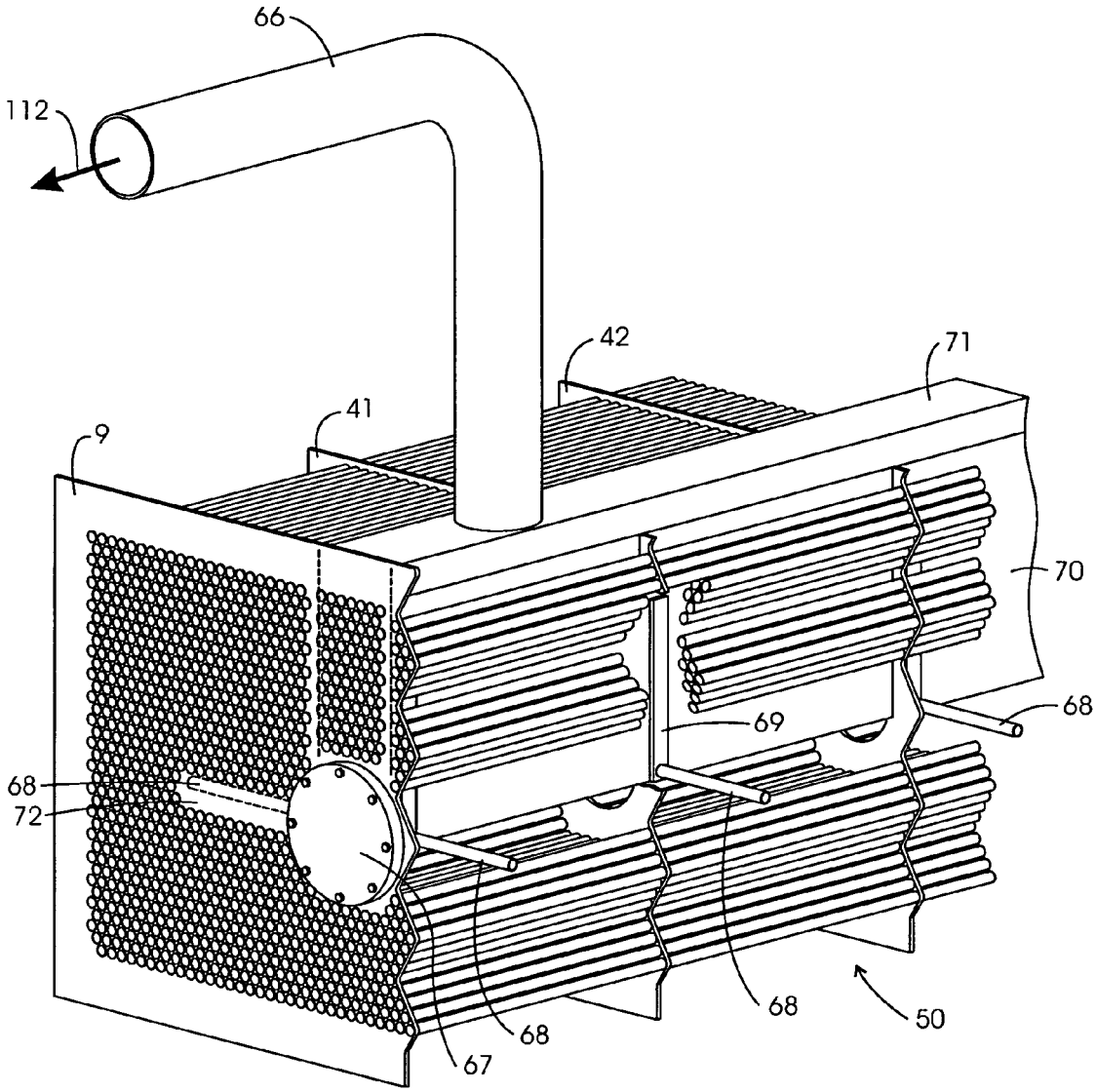
FIG. 9 shows a modification providing an air removal vent shroud and air vent lane suction tubes installed during a retubing operation.

FIG. 9 shows another configuration of the instant apparatus where retubing is to be done using the same tube sheet and support plate layout configuration, but permitting the construction of a shrouded air removal section of the type described in the '970 patent. Here, air-venting lanes, 72, can be adequately vented through vent side pipes 68 coupled to vertical venting channels, 69, located along the inlet end of each bay in the condenser between tube sheets 9 and support plates 41 or between adjacent support plates 41. Orifices on the inside of each vertical vent channels 69 are exposed to a lower pressure than at the tips of vent pipes 68 providing positive suction for venting tips of the air vent lanes.

4. Use

The appropriate region for locating the DBAE is near the center of the air pocket or modeled region of air concentration defined by the scavenging process or at the location of air concentration near to a deficient air removal section of a tube bundle. A circulating water tube in the bundle can be selected at an identified location, as shown in FIG. 5, and removed from the bundle to make space available for a single prefabricated and perforated DBAE air tube. The DBAE, then, can be inserted into this available location along the length of the condenser. An option is to select a suitable, existing tube in the bundle and perforate it from inside the tube using a suitable axially inserted punch. As shown in FIG. 5, connection is made at one end of the DBAE tube to a low-pressure vacuum system and the other end of the DBAE can be plugged. A multiple tube DBAE, as shown in FIG. 6, may be used for increased venting along the length of the condenser. Additionally a DBAE having tubes larger than the condenser tubes can be fitted to a flange adapter and inserted through a large hole in the inlet tube sheet and coupled to a vent line as shown in FIG. 7. An option is to couple one large pipe to the flange adapter for insertion through the tube sheet opening, the pipe having appropriate holes to allow venting along its full length with a small defined pressure drop across each hole.

Since feed water heaters suffer a similar problem of air pockets, for example, in the steam space between tubes and an outer shell with feed water passing through tubes, one of the tubes or a special vent tube could be connected through the outside of the shell and, after passing through controlled restriction, could be connected to the condenser near the hotwell region to return small amounts of high pressure steam containing problematic air to condenser where the air is removed by the condenser venting system. A second approach would be to vent the controlled steam containing air directly to the atmosphere because of known pressure differential.

5. Features

There is no known device that is available to allow for deep bundle air extraction, from air pockets known generally as Air Bound (AB) zones, without first dismantling significant portions of the condenser or heat exchangers to install complex or necessary modification parts. Exacerbating this problem are the dynamics creating AB zones, which have not been comprehensively understood to permit identifying the location of AB zones as described in the '755 patent and the '970 patent. Additionally, when tubes become significantly corroded, it is common practice to remove the old tubes and replace them with new tubes. Once tubes are removed it is easy to install elements of the DBAE to adequately achieve improved venting particularly in regions of the bundle having internal air venting lanes. This method and device has the following novel features which are not disclosed in prior works:

a. It is easily installed.
b. It is the only known method for deep bundle air extraction without significant modification to portions of the condenser or heat exchangers.
c. It provides air extraction in regions where air exists thereby improves heat transfer, increased steam condensation rate or improved heat exchanger performance, reduced dissolved gases in condensate and lower corrosion rates of power plant components.

d. It can be configured as single or multiple tubes or penetrated pipes of various length each extending a certain distance between tube sheets or into air venting lanes for removing air of different amount along the length and width of the condenser or heat exchangers.

e. It can be used to retrofit and make effective the design deficient air removal sections of condensers.

f. It can be connected to a novel heat exchanger located in the water box for increased condenser venting.

g. The DBAE configurations can be used in intermediate and high pressure feed water heaters having similar air pockets but operating at higher temperature and pressure.

h. The principles can be used to correct errant condenser configurations of existing condensers indefinably different configurations during a retubing process or by virtue of these techniques employed to prevent air binding by design of new condensers by preventing their development or by providing suitable venting not here-to-for employed.

6. Advantages

This disclosure is the first of its kind and can be adapted for any tube bundle configuration found in steam surface condensers or feed water heaters exhibiting a condition of air binding and/or inadequate air removal.

7. Testing Results

The measurement of effects caused by air pockets in condensers is comprehensively described by the new model and theory described in U.S. Pat. Nos. 6,526,755 and 7,065,970 and in technical publications by the inventors. Computer simulations show that at a differential pressure across a single 1" diameter DBAE tube containing small multiple holes along its length (i.e., between the suction device and the condenser steam/air space) can provide for a pressure drop of 0.2-0.5"HgA across the holes and allow for a ~0.3 SCFM air flow per DBAE tube. In another design, simulations show that DBAE assembly containing a cluster of eight 1.5"-2" diameter tubes can provide about 0.3 SCFM air removal per DBAE tube for the entire length of a large-scale condenser tube bundle. Another single pipe extending from the inlet tube sheet to the last bay of the condenser having fixed single or double holes per bay will adequately vent the condenser with a pressure differential across each hole at 0.2"HgA.

Another analysis shows that internal vent lanes to the side of an essentially central venting tube configuration can be adequately vented by DBAE venting tubes connected to a reconfigured and shrouded ARS to take advantage of low pressure regions of the ARS.

Measurements of individual tube circulating water flow rates and circulating water temperature rise have shown that regions of an operating tube bundle suspected of being air bound exhibited low heat transfer coefficients as predicted by their presence.

While the method and apparatus has been described with reference to various embodiments, those skilled in the art will understand that various changes may be made and equivalents may be substituted for elements thereof without departing from the scope and essence of the disclosure. In addition, many modifications may be made to adapt a particular situation or material to the teachings of the disclosure without departing from the essential scope thereof. Therefore, it is intended that the disclosure not be limited to the particular embodiments disclosed, but that the disclosure will include all embodiments falling within the scope of the appended claims. In this application all units are in the US system, unless otherwise expressly indicated. Also, all citations referred herein are expressly incorporated herein by reference.

We claim:

1. A method for effective venting of a condenser of the type having a circulating water inlet water box and outlet water box coupled with interconnecting water filled tubes passing within a shell containing steam to be condensed to form a condensate, an air removal section ("ARS"), the improvement for one or more of reducing dissolved oxygen (DO) or other gases content in said condensate, reducing condensate and feed water side corrosion, reducing excess condenser pressure in the condenser, or improving the condenser heat transfer coefficient by eliminating or reducing zones that promote subcooling resulting from an air bound zone or a stagnant zone, which comprises the steps of:

replacing one or more of water filled tubes within said air bound zone or said stagnant zone with one or more vent tubes in connection with a source for venting air or other gas from said air bound zone or said stagnant zone; or providing one or more vent tubes in connection with a source for venting said air bound zone or said stagnant zone;

wherein one or more vent tubes having apertures are inserted into said zones that promote subcooling such that said apertures are located within said zones that promote subcooling; and connecting said one or more vent tubes to a suction device for removing one or more of non condensable gases or water vapor from said zones that promote subcooling; and wherein said vent tubes are formed by replacing one or more water filled tube extending to within said zones that promote subcooling with vent tubes having apertures and connected to said suction device.

2. The method of claim 1, wherein said vent tubes are of different length.

3. The method of claim 1 wherein said suction device comprises one or more of:

(a) providing a vent pipe connection through the inlet water box to external venting equipment or vacuum pump; or (b) providing a water cooled condenser with tubes inside the inlet water box for condensing water vapor contained in vented mixture to reduce water vapor content flowing to the venting equipment and improving the capacity of the venting equipment for noncondensable gas removal; or (c) providing a water cooled condenser between the condenser and venting equipment in the vent line outside the condenser with a separate supply of cooling water for water vapor content reduction in vent line mixture to the vacuum pump; or (d) providing a drain in the vent pipe coupled to a loop trap for returning water back to the condenser.

4. A method for effective venting of a condenser of the type having a circulating water inlet water box and outlet water box coupled with interconnecting water filled tubes passing within a shell containing steam to be condensed to form a condensate, an air removal section ("ARS"), the improvement for one or more of reducing dissolved oxygen (DO) or other gases content in said condensate, reducing condensate and feed water side corrosion, reducing excess condenser pressure in the condenser, or improving the condenser heat transfer coefficient by eliminating or reducing zones that promote subcooling resulting from an air bound zone or a stagnant zone, which comprises the steps of:

replacing one or more of water filled tubes within said air bound zone or said stagnant zone with one or more vent tubes in connection with a source for venting air or other gas from said air bound zone or said stagnant zone; or providing one or more vent tubes in connection with a source for venting said air bound zone or said stagnant zone;

wherein one or more vent tubes having apertures are inserted into said zones that promote subcooling such that said apertures are located within said zones that promote subcooling; and connecting said one or more vent tubes to a suction device for removing one or more of non condensable gases or water vapor from said zones that promote subcooling; and wherein said vent tubes are formed by replacing one or more water filled tube extending to within said zones that promote subcooling with vent tubes having apertures and connected to said suction device.

5. A method for effective venting of a condenser of the type having a circulating water inlet water box and outlet water box coupled with interconnecting water filled tubes passing within a shell containing steam to be condensed to form a condensate, an air removal section ("ARS"), the improvement for one or more of reducing dissolved oxygen (DO) or other gases content in said condensate, reducing condensate and feed water side corrosion, reducing excess condenser pressure in the condenser, or improving the condenser heat transfer coefficient by eliminating or reducing zones that promote subcooling resulting from an air bound zone or a stagnant zone, which comprises the steps of:

replacing one or more of water filled tubes within said air bound zone or said stagnant zone with one or more vent tubes in connection with a source for venting air or other gas from said air bound zone or said stagnant zone; or providing one or more vent tubes in connection with a source for venting said air bound zone or said stagnant zone;

wherein baffles are inserted into said zones that promote subcooling to shift the location of said zones that promote subcooling.

6. A method for effective venting of a condenser of the type having a circulating water inlet water box and outlet water box coupled with interconnecting water filled tubes passing within a shell containing steam to be condensed to form a condensate, an air removal section ("ARS"), the improvement for one or more of reducing dissolved oxygen (DO) or other gases content in said condensate, reducing condensate and feed water side corrosion, reducing excess condenser pressure in the condenser, or improving the condenser heat transfer coefficient by eliminating or reducing zones that promote subcooling resulting from an air bound zone or a stagnant zone, which comprises the steps of:

replacing one or more of water filled tubes within said air bound zone or said stagnant zone with one or more vent tubes in connection with a source for venting air or other gas from said air bound zone or said stagnant zone; or providing one or more vent tubes in connection with a source for venting said air bound zone or said stagnant zone;

wherein one or more vent tubes having apertures are inserted into said zones that promote subcooling such that said apertures are located within said zones that promote subcooling; and connecting said one or more vent tubes to a suction device for removing one or more of non condensable gases or water vapor from said zones that promote subcooling; and wherein the internal condenser structure can be modified during retubing, permitting venting tubes to be located within internal air venting lanes and erecting a shrouded air removal section, the improvement comprising the steps of: extending the lane venting tubes radially outward from the air removal section and coupling the inward end directly into the air removal shroud for venting the tube bundle in a region existing along and near the end of the extension tube.

* * * * *